United States Patent [19]

Montealegre

[11] 4,313,554

[45] Feb. 2, 1982

[54] MULTI-CELL DIVIDER CARTON

[75] Inventor: James Montealegre, St. Paul, Minn.

[73] Assignee: Champion International Corporation, Stamford, Conn.

[21] Appl. No.: 155,096

[22] Filed: Jun. 2, 1980

[51] Int. Cl.[3] ..... B65D 5/48

[52] U.S. Cl. ..... 229/28 R

[58] Field of Search ..... 229/28 R, 28 BC, 29 B, 229/29 C, 29 D, 38

[56] References Cited

U.S. PATENT DOCUMENTS

| | | | |
|---|---|---|---|
| 2,883,098 | 4/1959 | Horner | 229/28 R |
| 2,943,763 | 7/1960 | Richardson | 229/28 BC X |
| 2,979,226 | 4/1961 | Vesak | 229/28 BC X |
| 3,070,258 | 12/1962 | Engel | 229/28 BC X |
| 3,625,412 | 12/1971 | Rosenburg, Jr. | 229/39 |

*Primary Examiner*—Herbert F. Ross

*Attorney, Agent, or Firm*—Evelyn M. Sommer

[57] ABSTRACT

A carton having a plurality of compartments or cells formed from a single, unitary, paperboard blank.

18 Claims, 9 Drawing Figures

Fig. 3.
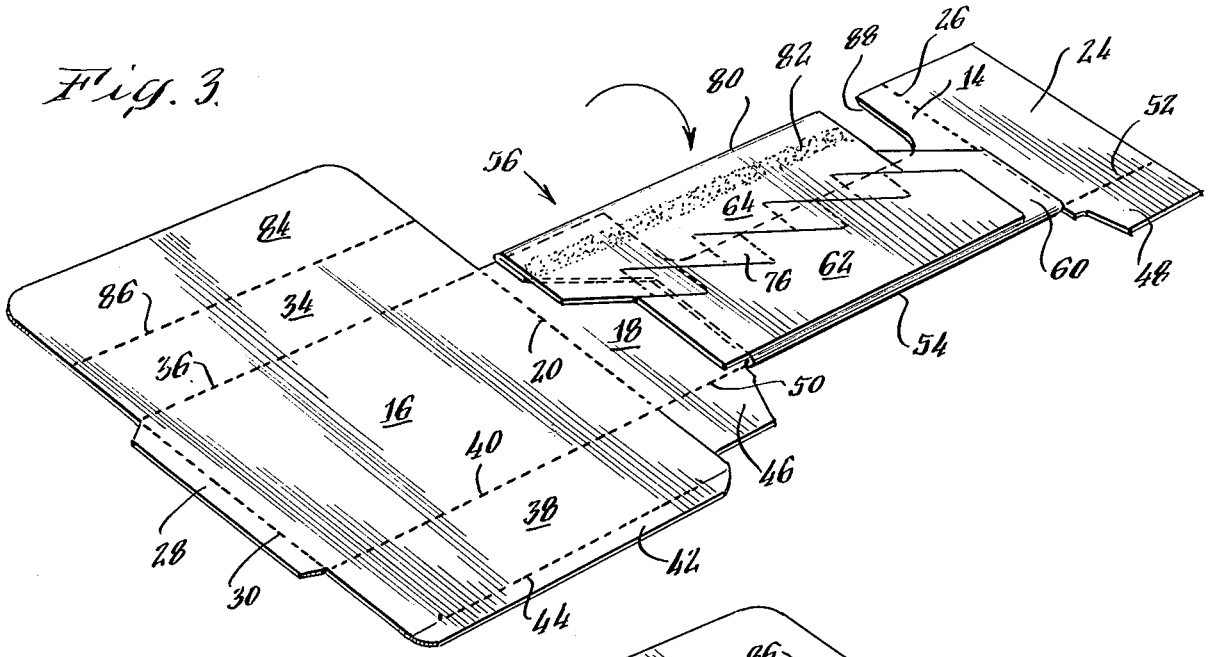
Fig. 4.
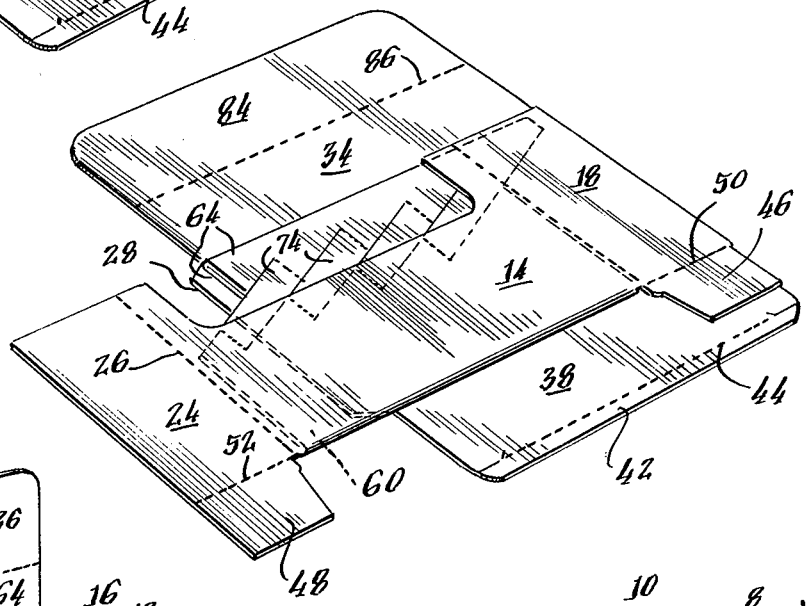
Fig. 5.
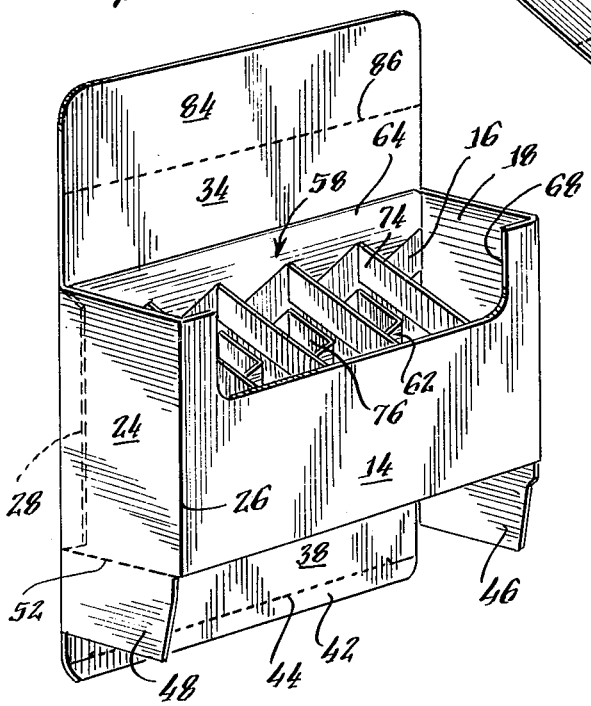
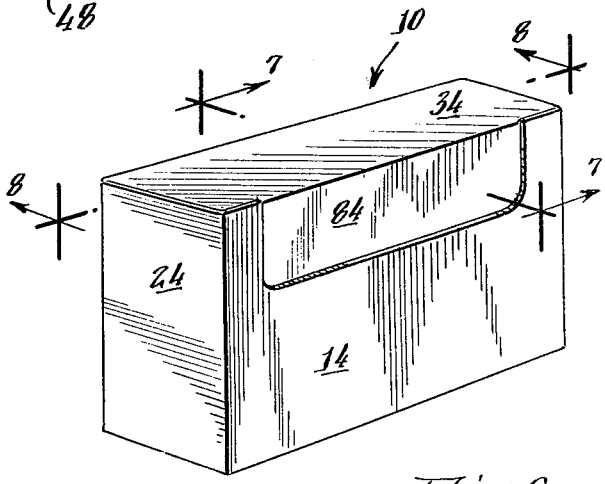
Fig. 6.

MULTI-CELL DIVIDER CARTON

BACKGROUND OF THE INVENTION

1. Field of the Invention

This invention relates to a carton construction, and more particularly, a carton construction provided with a plurality of spaced cells or compartments in the interior thereof, and a unitary blank for manufacturing the same.

2. Description of the Prior Art

Multi-cell divided cartons are used to hold articles in a specific configuration or for holding the articles in place relative to each other to avoid damage during shipment. An example of such a carton is one that holds bottles which is shipped from a distributor to a retail establishment and the carton can be used to display the bottles at the establishment.

Heretofore, the multi-cell dividers utilized in such a carton included one or more pieces separate from the carton. For example, one known divider comprises separate pieces which are perpendicularly interleaved at spaced intervals along one of the pieces and placed within the interior of the carton. Alternatively, a multi-cell divider included portions which were adhesively connected to each other at perpendicular intervals and manually placed within the interior of a rectangular parallelopiped carton. In either event, the assembly of such cartons are time-consuming and require shipment and assembly of separate pieces.

RELATED APPLICATION

Reference is made to copending application Ser. No. 154,792 filed May 30, 1980 by the same inventor.

SUMMARY OF THE INVENTION

In accordance with the present invention, a multi-cell divided carton can be constructed from a unitary, one-piece, paperboard blank which can be shipped flat to the user, wherein it can be assembled without any special machinery, effecting significant savings in shipping costs, assembly costs, and material costs.

The blank includes a front and rear panel connected by one side panel. A second side panel is connected to the free side edge of the front panel. A glue flap extends from the free side edge of the rear panel which is overlapped with the free edge of the remaining side panel to form a tubular carton construction having a rectangular parallelopiped configuration. A cover element is hingedly connected to the top edge of the rear panel and a bottom wall panel is hingedly connected to the opposite, lower edge of the rear panel. The bottom wall panel includes a flap which can be tucked into the rectangular parallelopiped enclosure to form a closed, bottom wall.

Foldably connected to the bottom edge of the front wall panel of the blank is a one-piece panel for forming an interior, multi-cell divider construction for the interior of the carton, when assembled. The divider panel includes an upper and lower panel portion which constitutes the mirror images of each other, except that the lower panel portion is offset laterally, slightly towards the rear wall panel of the blank. The upper and lower panel portions of the divider panel are interconnected by a central hinged panel including a plurality of trapezoidal-shaped portions aligned so that the base of one of the trapezoidal portions coincides with the top edge of an immediately preceding trapezoidal portion.

The edges of the bases of each of the trapezoidal portions of the central panel which overlap the top edge of a preceding trapezoidal panel portion is hingedly connected by a parallelogram shaped strip to each of the top and bottom mirror-image panel portions in the divider panel. The strips connecting the bases of the trapezoidal portions of the central panel to the top mirror-image panel are approximately twice the length of those connecting the bases of the trapezoidal portions to the bottom mirror-image panel.

Upon assembly and erection of the carton, the top, mirror-image portion of the divider panel is foldable over the interior surface of the front wall panel of the carton blank along the bottom edge of the front wall panel and adhesively connected thereto. The central panel portion of the divider panel including the trapezoidal aligned portions is then folded back upon itself so that the free edge of the other or bottom mirror-image portion of the divider panel coincides with the bottom edge of the front wall panel of the carton blank. The rear of the hinged center portion is then adhesively connected to the rear wall panel of the carton which is folded relative thereto about one of the side edges of the first side wall panel. The glue flap is then connected to the free edge of the second side flap to form the tubular enclosure and the top and bottom wall flaps folded to form a top and bottom wall for the carton.

When thus erected, the bottom mirror-image portion of the divider panel extends midway between the front and rear wall panels of the carton to form a central divider extending the entire width of the carton, The shorter parallelogram strips space the bottom panel portion of the divider from the rear wall of the carton. The longer parallelogram strips extend between one of the folded portions of the central trapezoidal panel now adhered to the rear wall and the top mirror-image portion of the divider panel construction now adhered to the front panel wall of the carton. The longer strips are above the shorter strips but lie in the same vertical plane so that the strips and the bottom mirror-image portion now in the center of the carton form a perpendicular cross divider structure fro receiving bottles or the like in a plurality of compartments.

BRIEF DESCRIPTION OF THE DRAWINGS

Further objects and advantages of the present invention will become apparent from the following description and claims, and from the accompanying drawings, wherein:

FIGS. 2–5, inclusive, are perspective views illustrating the mode of folding the blank of FIG. 1 to form the multi-cell divider carton of the present invention;

FIG. 6 is a perspective view of the erected multi-cell divider carton of the present invention;

DETAIL DESCRIPTION OF THE PREFERRED EMBODIMENT

Figure 1:
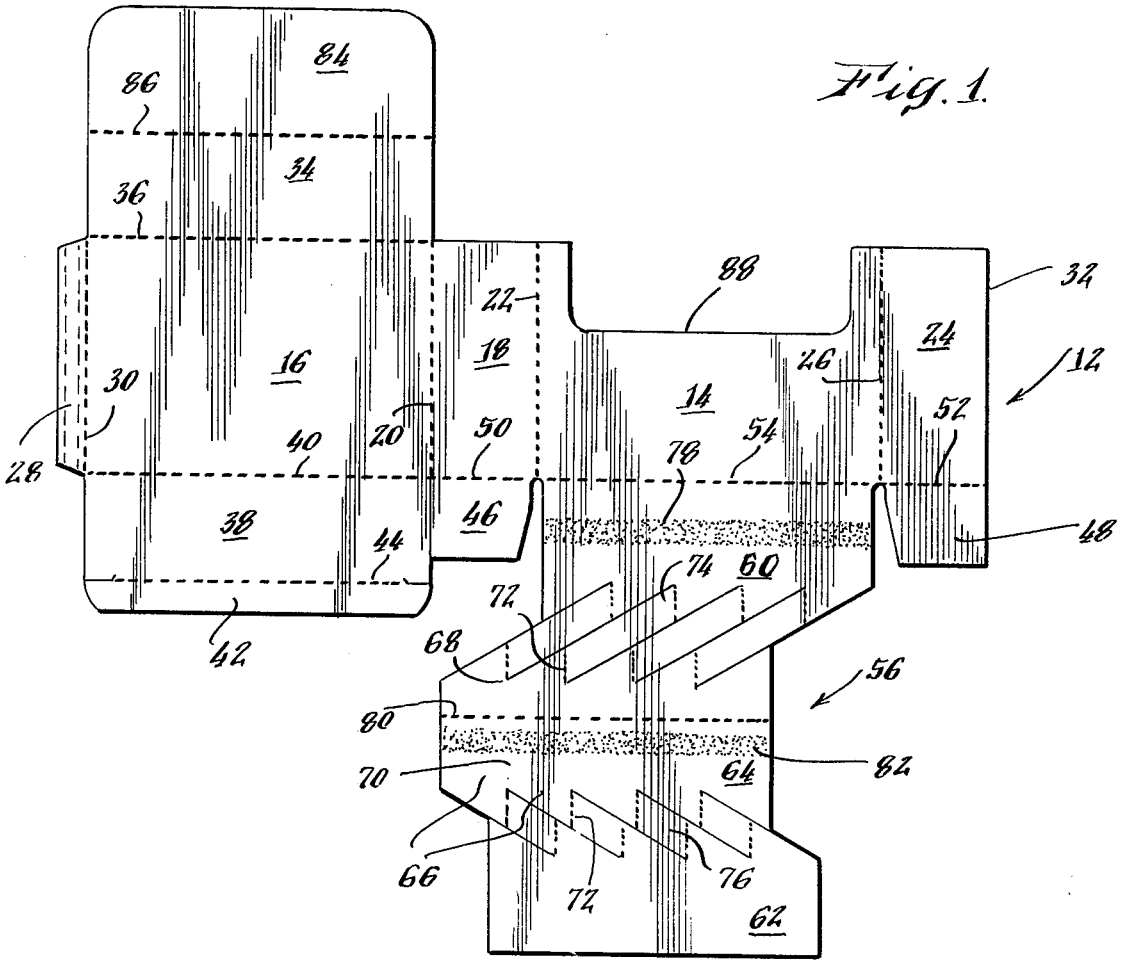
FIG. 1 is a top plan view of a blank for forming the multi-cell divider carton of the present invention.

Referring now to the drawings in detail, wherein like numerals indicate like elements throughout the several views, a multi-cell divided carton 10 can be constructed from a unitary, one-piece paperboard blank 12 illustrated in FIG. 1. The blank 12 can be shipped flat to the user, wherein it can be assembled without any special machinery, effecting significant savings in shipping costs, assembly costs, and material costs.

The blank 12 includes a front and rear panel 14 and 16, respectively, connected by one side panel 18 foldable along opposed edges 20 and 22. A second side panel 24 is connected to the free side edge 26 of the front panel 14. A glue flap 28 extends from the free, foldable side edge 30 of the rear panel 16 which is overlapped with the free edge 32 of the side panel 24 to from a tubular carton construction having a rectangular parallelopiped configuration, as is shown in FIGS. 5 to 9.

A cover element 34 is hingedly connected to the top edge 36 of the rear panel 16 and a bottom wall panel 38 is hingedly connected to the opposite, lower edge 40 of the rear panel 16. The bottom wall panel 38 includes a flap 42 connected by a fold line 44 to bottom wall panel 38, which can be tucked into the rectangular parallelopiped enclosure of carton 10 to form a closed, bottom wall. Bottom flaps 46 and 48 are also connected by fold lines 50 and 52, respectively to the bottom of side flaps 18 and 24, respectively, and lie beneath the bottom wall 38 in carton 10.

Foldably connected to the bottom edge 54 of the front wall panel 14 of the blank 12 is a one-piece panel 56 for forming an interior, multi-cell divider construction 58 for the interior of the carton 10, when assembled, as illustrated in FIGS. 5, 7, 8 and 9. The divider panel 56 includes an upper and lower panel portion 60 and 62, respectively, which constitute the mirror-images of each other except that the lower panel portion 62 is offset laterally, slightly towards the rear wall panel 16 of the blank 12. The upper and lower panel portions 60 and 62 of the divider panel 56 are interconnected by a central hinged panel 64 including a plurality of trapezoidal-shaped portions 66 aligned so that the base 68 of one of the trapezoidal portions coincides with the top edge 70 of an immediately preceding trapezoidal portion. The edges 72 of the bases 68 of each of the trapezoidal portions 66 of the central panel 56 which overlap the top edge 70 of a preceding trapezoidal panel portion 66 is hingedly connected by a parallelogram shaped strip 74 and 76, respectively, to each of the top and bottom mirror-image panel portions 60 and 62, respectively, in the divider panel 56. The strips 74 connecting the bases 68 of the trapezoidal portion 66 of the central panel 56 to the top mirror-image panel 60 are approximately twice the length of those strips 76 connecting the bases 68 of the trapezoidal portions 66 to the bottom mirror-image panel 62.

Figure 2:
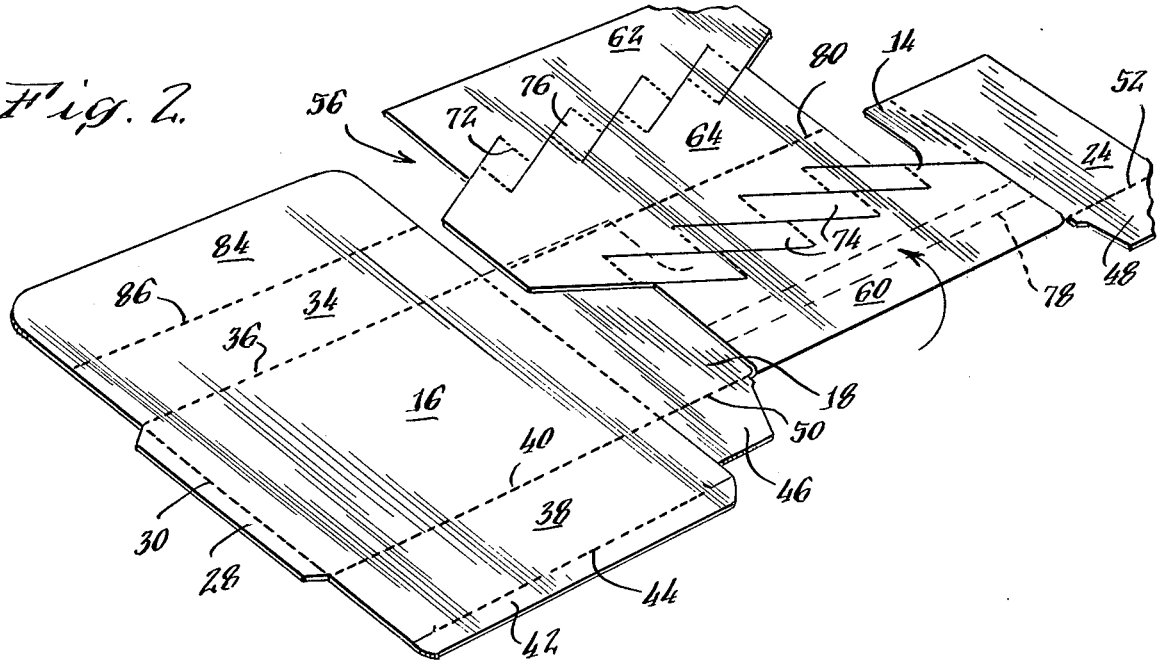
Figure 7:
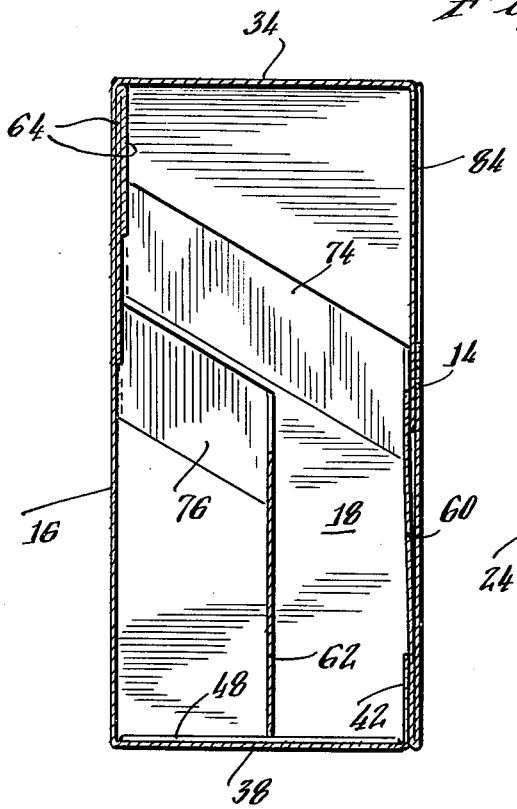
FIG. 7 is a cross sectional view taken substantially along the plane indicated by line 7—7 of FIG. 6.
Figure 9:
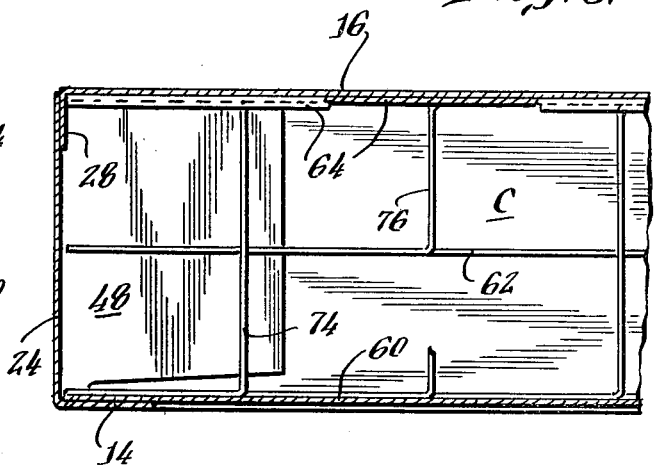
FIG. 9 is a cross-sectional view taken substantially along the plane indicated by line 9—9 of FIG. 8.
Figure 8:
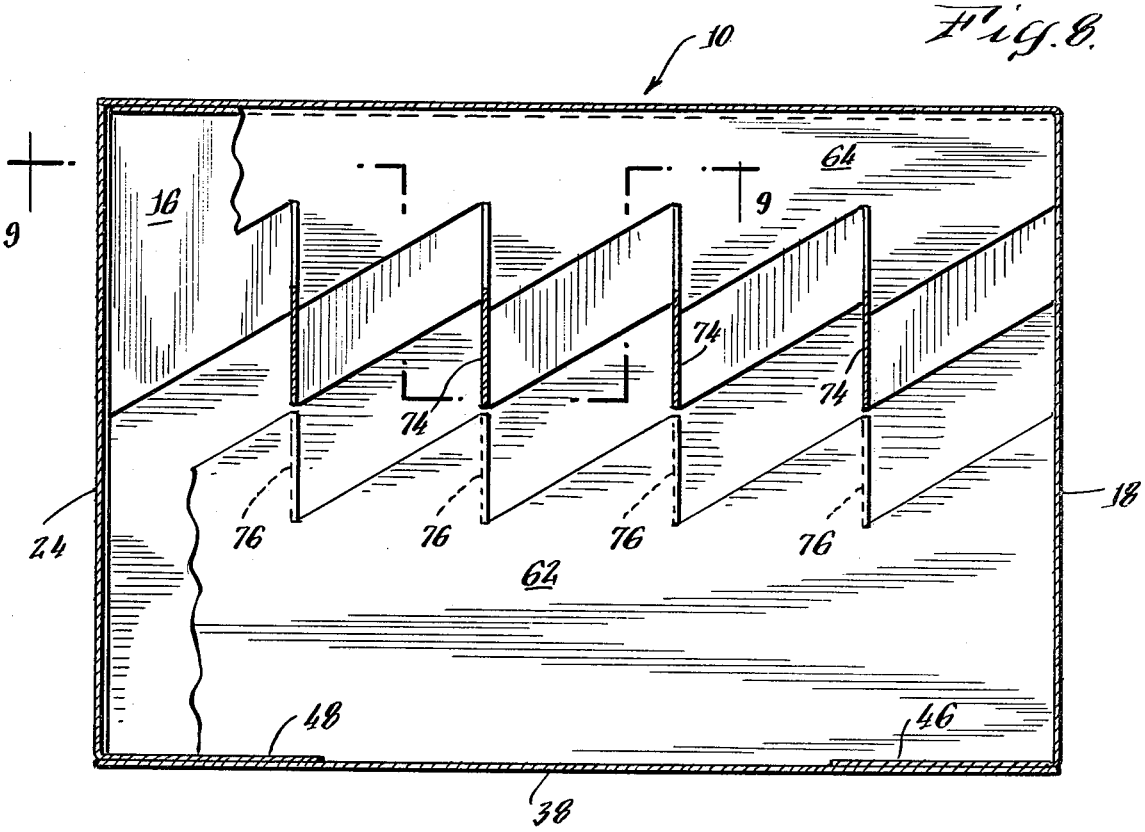
FIG. 8 is a cross sectional view taken substantially along the plane indicated by line 8—8 of FIG. 6.

Upon assembly and erection of the carton 10, the top, mirror-image portion 60 of the divider panel 56 is foldable over the interior surface of the front wall panel 14 of the carton blank 12 along the bottom edge 54 of the front wall panel 14 and adhesively connected thereto, by a line of adhesive 78, as shown in FIG. 2. The central hinged panel 64 of the divider panel 56 including the trapezoidal aligned portions 66 is then folded back upon itself on a fold line 80 which approximately bisects panel portion 64, as shown in FIG. 3 so that the free edge of the other or bottom mirror-image portion 62 of the divider panel 56 coincides with the bottom edge 54 of the front wall panel 14 of the carton blank 12. The rear of the hinged center panel portion 64 is then adhesively connected by a line of adhesive 82 to the rear wall panel 16 which is folded relative thereto about the side edge 20 of the first side wall panel 18, as illustrated in FIG. 4. The glue flap 28 is then connected to the free edge 32 of the second side flap 24 to form the tubular enclosure of FIG. 5 and the top and bottom wall flaps 34 and 38, respectively, folded to form a top and bottom wall for the carton 10.

Top wall flap 34 also has a tuck flap 84 hingedly connected along a fold line 86 to flap 34. Tuck flap 84 is received within the enclosure of carton 10 to close a three-sided opening 88 cut in front wall panel 14. By deleting the tuck flap 84, as for example, by tearing it from the cover along line 86, the goods within carton 10 housed within the divider construction 58, can be displayed.

When thus erected, the bottom mirror-image portion 62 of the divider panel 56 extends midway between the front and rear wall panels 14 and 16 of the carton 10, as shown in FIGS. 5 to 9, to form a central divider extending the entire width of the carton. The shorter parallelogram strips 76 space the bottom panel portion 62 of the divider panel 56 from the rear wall 16 of the carton 10. The longer parallelogram strips 74 extend between one of the folded portions of the central panel 64 now adhered to the rear wall 16 and the top mirror-image portion 60 of the divider panel construction 56 now adhered to the front wall panel of the carton 10. The longer strips 74 are above the shorter strips 76, but lie in the same vertical plane so that the strips and the botton mirror-image portion 62 of divider panel 57 is disposed in the center of the carton to form the perpendicular, cross-divider structure 58 for receiving bottles or the like in a plurality of compartments C.

What is claimed as new is:

1. A multi-cell divider carton comprising a front wall, a substantially parallel rear wall, a pair of side walls connecting said front and rear walls, a bottom wall, a top wall cover element hingedly connected to said rear wall, and a divider panel within the interior of said carton between said front, rear, and side wall, said divider panel including a portion secured to said rear wall and a second portion secured to said front wall, a divider wall substantially parallel to and spaced from said front and rear walls extending substantially the entire width of said carton between said side walls, said divider wall being hingedly connected to said first divider wall portion secured to said rear wall by a first set of a plurality of parallelogram strips hingedly connected to said portion secured to said rear wall and said divider wall, and a second set of a plurality of parallelogram strips extending between a portion of said divider panel secured to said front wall and a portion of said divider panel secured to said rear wall of above said first set of parallelogram strips extending between the portion of said divider panel secured to said rear wall and said divider wall, said first and second sets of parallelogram strips having individual strips lying in corresponding vertical planes to form with said divider wall a plurality of compartments within said carton.

2. The carton of claim 1 wherein said divider panel is secured to a bottom edge of said front wall.

3. The carton of claim 1 wherein each of the parallelogram strips of said second set of strips is approximately twice the length of each of the parallelogram strips of said first set strips connecting said divider wall to the portion of said divider wall panel secured to said rear wall of said carton.

4. The carton of claim 3 wherein front wall includes a cut-out portion, and said top wall includes a hinged tuck flap received within said carton enclosure to cover said front wall cut-out portion.

5. The carton of claim 3 wherein said bottom wall includes a hinged tuck flap received within said carton enclosure.

6. The carton of claim 3 wherein said front and rear side walls form a tubular enclosure substantially in the shape of a rectangular parallelopiped.

7. A unitary, planar paperboard blank for constructing the multi-cell divider carton of claim 1.

8. A unitary, planar paperboard blank for constructing the multi-cell divider carton of claim 2.

9. A unitary, planar paperboard blank for constructing the multi-cell divider carton of claim 3.

10. A unitary, planar paperboard blank for constructing the multi-cell divider carton of claim 4.

11. A unitary, planar paperboard blank for constructing the multi-cell divider carton of claim 5.

12. A unitary, planar paperboard blank for constructing the multi-cell divider carton of claim 6.

13. A blank for constructing a multi-cell divider carton comprising:

a first panel for fomring the front wall of said carton, a second panel for forming the rear wall of said carton, a third panel for forming a side wall of said carton foldably connected between parallel edges of said first and second panels, a fourth panel for forming a side wall of said carton foldably connected to an opposite edge of said first panel, a glue flap foldably connected to an opposite edge of said second panel, a cover flap for said carton foldably connected to a top edge of one of said first and second panels, a bottom wall flap for said carton foldably connected to a bottom edge of one of said first and second panels, and a divider panel for the interior of said carton foldably connected to a bottom edge of the other one of said first and second panels, said divider panel including a top panel portion, a bottom panel portion substantially the mirror image of said top panel portion, and a central portion between said top and bottom panel portion, said central portion having a plurality of aligned, trapezoidal portions wherein the base of one said trapezoidal portions coincides with the top edge of an immediately succeeding one, the coincidental bases of each said trapezoidal portions being hingedly connected to each of said top and bottom panel portions by a parallelogram shaped strip.

14. The blank of claim 13 wherein the strips connecting the trapezoidal portions of said central portion to said top panel portion are approximately twice the length of the strips connecting the trapezoidal portion of said central portion to said bottom panel portion.

15. The blank of claim 14 wherein said bottom panel portion is laterally displaced with respect to said top panel portion.

16. The blank of claim 15 wherein said central panel portion includes a fold line extending the length thereof.

17. The blank of claim 16 wherein said central panel portion includes a line of adhesive.

18. The blank of claim 17 wherein said top panel includes a line of adhesive.

* * * * *